United States Patent [19]

Thornton et al.

[11] 4,263,358

[45] Apr. 21, 1981

[54] MULTIZONAL BINDER IMPREGNATION

[75] Inventors: Alan Thornton, Halifax; John S. Uttley, Hebden Bridge, both of England

[73] Assignee: Bodina, Ltd., Yorkshire, England

[21] Appl. No.: 571,888

[22] Filed: Apr. 25, 1975

[51] Int. Cl.[2] ..... B32B 3/00; B32B 7/14

[52] U.S. Cl. ..... 428/195; 428/48; 428/212; 428/338; 428/339; 428/349

[58] Field of Search ..... 428/195, 292, 296, 260, 428/280, 198, 48, 211, 349, 212, 338, 339; 427/209, 258–263, 267, 284, 285, 286, 288, 411, 412

[56] References Cited

U.S. PATENT DOCUMENTS

| | | | |
|---|---|---|---|
| 430,707 | 6/1890 | Strahan | 427/288 |
| 2,096,710 | 10/1937 | Emmey | 428/260 |
| 2,670,315 | 2/1954 | Rider | 428/198 X |
| 2,932,855 | 4/1960 | Bartlett et al. | 427/209 X |
| 3,483,017 | 12/1969 | Korpman | 427/209 |
| 3,687,712 | 8/1972 | Hartmann | 427/209 X |
| 3,716,395 | 2/1973 | Bauer et al. | 427/209 X |
| 3,748,216 | 7/1973 | Brock | 428/296 X |
| 3,782,995 | 1/1974 | Takimoto et al. | 427/209 |
| 3,889,018 | 6/1975 | Quint | 427/209 |
| 3,908,058 | 9/1975 | Russell et al. | 427/412 X |

*Primary Examiner*—Bernard D. Pianalto

*Attorney, Agent, or Firm*—Sprung, Felfe, Horn, Lynch & Kramer

[57] ABSTRACT

An interlining material comprising a web of non-woven fibers, said web having a first zone having distributed uniformly therein a binder, said first zone disposed proximate to but not in contacting relationship with a second zone having distributed uniformly therein a binder, the binding characteristics of said first zone being distinctly different from the binding characteristics of said second zone, said zones being interconnected by an intermediate zone, said intermediate zone containing a mixture of the binder of said first zone and the binder of said second zone, said intermediate zone having binding characteristics intermediate that of said first and second zone, the binders of said first and second zones merging with one another in said intermediate zone; a method of making an interlining material by uniformly applying to a first zone of a web of non-woven fiber a binder such as a liquid binder so that said zone has a uniform binder content therein, and applying to a second zone proximate thereto but not contiguous therewith a binder so that said second zone has a uniform binder content, the binder content of said first and second zones such that said zones have different binding characteristics.

9 Claims, 6 Drawing Figures

MULTIZONAL BINDER IMPREGNATION

BACKGROUND OF THE INVENTION

1. Field of the Invention

This invention relates to a non-woven interlining fabric useful in the construction of garments, particularly coats and jackets. More especially this invention relates to a non-woven interlining having distinct zones characterized by different binder contents therein, said zones joining one another by an intermediate zone formed by a merging of the binders of each of the other zones, the binder in the zones separated by the intermediate zone being uniformly distributed therein. This invention relates especially to a non-woven interlining material having a first zone and a second zone proximate said first zone but not contiguous therewith, each of said first and second zones containing a liquid binder therein to impart to the zones definite flexibility and stiffness characteristics, said first and second zones being connected via an intermediate zone also of non-woven fibers containing binder of said first and second zones, said intermediate zone having flexibility and stiffness characteristics intermediate that of the zones on either side thereof.

2. Discussion of the Prior Art

Non-woven interlining fabrics are usually bonded by impregnating a non-woven web of fiber uniformly with a bonding agent. Commonly all or some of this impregnation is brought about by doctoring foamed or viscous bonding agent into the web as it passes between a supporting surface and a doctoring means that confines a pool of the bonding agent across the width of the fabric. The supporting surface is generally a roll and usually the doctoring means is as well. Thus commonly two substantially horizontal rolls are so arranged that the web passes over one roll and under the second and foamed adhesive is taken up by the web from a pool that extends across the web between the top of the web and the second roll.

Non-woven and other interlining fabrics have in the past usually had uniform properties across their area, but recently a demand has arisen for multizonal interlinings, that is to say fabrics that have, across their area, zones of differing properties, especially stiffness and handle. These permit a single piece of interlining to be used in a garment, for instance a mantle such as a coat or jacket, requiring interlinings having different properties in different areas. Thus a suitable multizonal interlining should have a bulky, firm rounding effect across the chest area of a coat or jacket with good rolling properties down the length of the garment.

Woven multizonal interlinings have been made by weaving the fabric appropriately. Another process has been described in British Pat. specification No. 911,517. This specification was concerned solely with the production of collar interlinings and in it the interlining is shaped as a collar and produced by printing onto cloth which is to form the interlining a resinous material, the printing being effected by means of an engraved roller or perforated hollow roller or a stencil in such a manner that a larger amount of the resinous material is applied where it is desired to increase stiffness and a lesser amount where the interlining is to be less stiff. The only cloth material described is a woven cotton cloth. Processes are known for providing a variable content of binder in non-woven products; for instance British Pat. specification 928,270 described how different amounts of a single liquid binder composition, and thus different concentrations of binder, can be applied to a web during the formation of a pad. Clearly, however, the requirements for forming a pad, which is necessarily very bulky and generally consists of several layers of fleece laminated to one another and which can have relatively poor surface quality, is very different from the requirements for the formation of an interlining since these have to be thin and have smooth uniform surface texture. A multizonal effect can be obtained in a non-woven interlining by printing lines of a thickened paste in different amounts on the different zones of a previously bonded web, drying it and sometimes calendering the lines of paste into the web. However, this is not entirely satisfactory since it requires additional processing steps and the heavily printed area may become compressed and reduced in thickness whereas this area should preferably be bulky. Also there may be non-uniform distribution of binder in each zone and the transition from the binder in one zone to the binder in the next tends to be sudden.

It has therefore become desirable to provide an interlining material having different binder content therein wherein the stiffness or flexibility characteristics of the binder do not change abruptly from one zone to another. It has become particularly desirable to provide such an interlining material with the zones having different flexibility characteristics although the binder in each zone is uniformly distributed throughout. It has become especially desirable to provide a non-woven interlining material having uniform surface texture and good bulk.

SUMMARY OF THE INVENTION

The objects of the present invention are provided by an interlining material comprising a web of non-woven fibers, said web having a first zone having distributed uniformly therein binder, said first zone disposed proximate to but not in contacting relationship to a second zone having distributed uniformly therein a binder, the binding characteristics of said first zone being distinctly different from said second zone, said zones being interconnected by an intermediate zone, said intermediate zone containing a mixture of the binder of said first zone and the binder of said second zone, said intermediate zone having binding characteristics that vary between the binding characteristics of said first and second zones, the binders of said first and second zones merging with one another in said intermediate zone.

In accordance with this invention there is provided a non-woven web bonded by a binder in which there are distinctly different zones, each of which has substantially uniform binder content therein. These zones are interconnected to one another through an intermediate zone which is characterized by being made also of a non-woven fabric wherein the binder of the first zone and the binder of the second zone merge so that the entire fabric has a gradual change in its binding characteristics from the first zone to the second zone via the intermediate zone. In all instances, the binder content is uniformly distributed in the zones such that there is no sudden change in properties.

The width of the intermediate zone over which the first and second zones merge into one another is generally at least 5 mm, for example 1 to 5 cm and sometimes more. Over this area the binder consists of a varying mixture of the binders present in each of its adjacent zones with the content of the mixture varying across the merging area. Naturally, the greatest change in content occurs in a fairly narrow area, for example, 2 to 5 mm wide. The described methods of printing binder to give multizonal interlinings seem to provide products in which the entire change occurs in an area as narrow as this with the result that the adjacent zones cannot be considered to merge into one another. It is for this reason that it is desired that the change occur over an area of at least 5 mm and preferably 1 to 5 cm so that there is a gradual change in the stiffness and flexibility characteristics of the zones.

It should be understood that the binding characteristics can be provided by regulating the amount of binder or by regulating the composition of the binder. For instance, it is possible to achieve the desired effects by using in one zone twice the binder content as employed in the second zone. In such a case the intermediate zone will contain an average of about 1.5 times the binder content of the zone of lesser binder content. This same effect, i.e., gradual change in stiffness and flexibility characteristics as well as handle, can be obtained by choosing different binder compositions. Thus, a binder which imparts greater stiffening can be applied to one zone, and the binder which imparts a lesser degree of stiffening can be applied to the second zone. The binders of these zones are caused to mingle and merge with one another in the intermediate zone so that the intermediate zone has binding characteristics intermediate the first and second zones.

As a result of the use of the different binders the bonding properties, for example the flexibility and handle, will be different in adjacent zones. The resultant ability to control variation of the bonding properties, and therefore of the fabric properties, from one zone to the other is very valuable. However, it may sometimes be undesirable for there to be too great a change in the bonding properties from one zone to another.

It will be understood that in general practice when a non-woven interlining product is made for use in suit jacket or coat manufacture, back-to-back fabrics can be made in a single operation. Thus, it would be customary to have a first zone joined to a second zone via an intermediate zone which second zone has disposed on its opposite side thereof a further zone having the same binding characteristics of the first-mentioned zone. Disposed between the first zone and the second zone is an intermediate zone as described above. Additionally, between the second zone and the first zone on the other side thereof there is a second intermediate zone. Thus, by cutting the fabric in the middle of the second zone, there are provided two separate non-woven webs of the invention, each of which contains a first and second zone joined by an intermediate zone. Thus, the interlinings may be considered to have first zones A and second zones B arranged in the manner A B A, it being understood that between A and B and B and A there are intermediate zones. In another embodiment of the invention a further zone having still different bonding characteristics can be provided in which event the fabric will have zones A B C, the bonding properties in the inner zone B being between the bonding properties in the two outer zones A and C. In such an embodiment there is an intermediate zone between zones A and B and a second intermediate zone between zones B and C. This second intermediate zone will have bonding characteristics intermediate the bonding characteristics of zones B and C.

The difference in binder content may reside solely in the difference in the amount of binder that is present. For instance the same chemical binder can be used in the two zones but the amount may be higher in one zone than in the other. Preferably, however, the binder in the different zones is formulated differently and of course, this is not possible if one merely applies different amounts of a single binder, for example by the method described in British Pat. specification No. 928,270. When different binders are used, the amounts of each in adjacent zones may be the same or different.

A separate feature of the invention resides in a method of making multizonal interlinings. According to this feature interlining comprising a non-woven web bonded by binder and in which the area of the web comprises first zones each of which has substantially uniform binder content and adjacent zones have different binder contents may be made by a method comprising applying to each zone of the fabric a substantially uniform overall distribution of liquid binder composition, the amount or content of the composition applied to adjacent zones being different.

Generally the content of the liquid composition that is applied to adjacent zones is different, different liquid compositions thus being applied to each zone. The required difference can reside solely in the concentration of binder in the liquid composition, with resultant differences in pick-up and final content of binder in the web, but often it resides from the use of different ingredients in the composition, for instance by the use of different binders or additives for them.

The non-woven webs used in the invention are preferably in the form of a continuous length when the binder is applied to them and preferably the zones extend in the length direction. The specified multizonal distribution of liquid binder composition is preferably made in a single pass onto a substantially unbonded web.

Liquid binder composition may be applied to the web by spraying or impregnation. Its application is preferably conducted in such a manner that adjacent zones merge into one another, in the manner described above. For example, different compositions may be applied through adjacent sprays that are positioned so as to achieve the desired merging; the preferred way of applying a liquid composition is by doctoring the compositions onto the web.

In a preferred process according to the invention a bonded non-woven fabric is made by doctoring viscous or foamed binder composition into a non-woven web as the web passes between a support surface and a doctoring means that confines a pool of the liquid binder composition on the web across the width of the web, and this process is characterized by the pool being divided into at least two sections of a baffle that prevents, or restricts to a controlled amount, transfer of composition from one section to an adjacent section, different liquid binder composition being supplied to adjacent sections.

When impregnating with foamed or viscous non-foamed bonding agent it might have been thought that it would be impossible to maintain the bonding agents in the pools on either side of the dividing plate sufficiently separate from one another by use of a baffle plate that identifiable zones were obtained and that the area of merging was not so great as to eliminate the zones themselves unless the plate presses so hard into the web as to displace fibers in the web and damage the web. In fact as a result of using a viscous or foamed adhesive it is found easily possible to control, and generally minimize, to a predetermined extent passage of bonding agent across the baffle, when a web is being made in which there are at least three zones, with one zone having bonding properties between its adjacent zones, there are various ways in which this can be achieved.

For example, the two baffle plates that separate the intermediate section of the pool of binder composition from the two adjacent sections can be positioned so as to permit a controlled transfer of compositions from the two adjacent sections to the intermediate section, the composition passing between each baffle plate and the web, or over each baffle. Generally, a mixer, for example, a simple rotor or other agitator, may be provided in the intermediate section to insure thorough mixing of the compositions from the two adjacent sections. The rates of supply of composition from each of the adjacent sections to the intermediate section, and therefore the content of the composition in the intermediate section, can be adjusted by appropriate positioning of the baffle plates.

Preferably, however, each baffle is positioned so as to substantially prevent passage of bonding agent across it and to permit only the formation of a relatively narrow merging area. Composition therefore has to be supplied direct to the intermediate section to create the necessary pool therein. The composition can be entirely different from either or both of the compositions in the adjacent sections but usually is a mixture of the bonding agents in the two adjacent sections.

It can be premixed, and fed direct to the central section in the same general manner as the other compositions are fed direct to the adjacent sections, but preferably is formed and mixed in situ in the central pool by allowing composition bonding agent from each of the two adjacent sections to pass into it over the two baffles. Conveniently the composition in each adjacent section is supplied to that section by a pipe or other outlet that traverses the section, and by arranging for each of these pipes to traverse also a part of the central section appropriate feed of composition from each of the adjacent sections to the central section can be made.

Although the supporting surfaces can be a conveyor belt or other flat surface and the doctoring means can be, for example, a doctor blade, it is preferred that both should be rolls, in the conventional manner, and so for convenience the following description is in terms of the use of a pair of rolls.

Although it is generally adequate to convert the wholly unbonded non-woven web as obtained from, for example, a cross lapper into the final bonded interlining by the method of bonding described above, it is sometimes convenient first to stabilize the non-woven web by bonding it uniformly across its width in some convenient method, for example by a uniform foam impregnation, or it may be given a uniform bonding across its width after carrying out the method of the invention. The differences in the liquid binder compositions supplied to adjacent sections can reside solely in their viscosity or foam density, since this will result in different degrees of pick-up, but generally reside in different concentrations of binder, or more usually, the use of different binders or different additives.

The binders used in the invention can be any suitable binders for bonding non-woven webs. Suitable binders are already widely known and used. If, as is preferred, it is to be applied in foam form any convenient method of foaming the liquid binder composition may be used and suitable methods are already in wide usage, and examples are described in British Pat. specification Nos. 728,865 and 898,432.

The web can be a uniform non-woven web having uniform properties across its width and through its thickness before impregnation but it is often advantageous that the web should have multizonal fiber distribution. Thus, the area of the web can comprise a plurality of zones, each of which has a uniform content therein, the fiber content of zones proximate to one another being different from one another, said zones being joined by an intermediate zone of fibers whose composition is intermediate the fibers of the zones on either side. Thus, the non-woven web of the invention which contains differing quantity or composition of binders can also have varying fiber content. For instance, there can be a zone of a uniform fiber composition connected to a zone of a different uniform fiber composition via an intermediate fiber zone of a fiber composition intermediate the two zones of uniform fiber composition. Preferably, the fibers of each of the zones merge with one another. In such an instance, the zones of uniform fiber composition and the zones of uniform binder content may coincide with the result that the binder changes at the same place as the fiber content, but often do not, so that the fiber content changes at one place while the binder content changes at another. When, as is preferred, interlining is in the form of or is cut from a continuous length, both the zones of uniform fiber composition and the zones of uniform binder content preferably extend longitudinally and preferably the fibers have a tendency to a dominant orientation in the length direction, since this gives better properties to the interlining when it is cut for a mantle across the machine direction.

The web, whether it be of uniform fiber content or of multizonal fiber content, can be formed of continuous filaments or of staple fibers. A staple fiber web may, for instance, have reinforcing filaments embedded in it, for instance so as to give multizonal properties to the fiber web itself, irrespective of the binder that is used. Although the web can be needled it is preferably a non-needled web in which the fibers have a random distribution throughout its thickness. A preferred method of making a suitable multizonal web comprises forming a laminar web of two or more fleeces, the area of the web comprising zones which each have substantially uniform fiber composition and in which adjacent zones have different fiber compositions, and then randomizing the distribution of fibers through the web and thereby insuring that the zones of uniform fiber composition merge into one another. In a preferred method the web is made by superimposing two crosslaid fleeces, one being wider than the other, and then randomizing this by passage through an apparatus such as the Proctor Isomizer as described in the Proctor and Schwartz Inc. Bulletin 549-1/72.

Particularly preferred webs having multizonal fiber distribution, and their manufacture, are described in our copending application, filed on even data herewith, Ser. No. 571,887, and now abandoned, corresponding to British patent application 9439/74.

In some instances it may be desirable for the web in at least one of the zones of uniform fiber composition to include binder fibers that bond other fibers in the web together. For example, the web may contain bi-component fibers the outer sheath of which has been fused to other fibers to bond them together.

The interlining may be positioned in the jacket or other garment in a convenient manner, for example by stitching or by adhesion. Thus, interlinings according to the invention may carry over part or all of their surface area, usually on one side only, thermoplastic adhesive so as to render them fusible. The thermoplastic adhesive is generally applied as a discontinuous coating by scattering, spraying or printing. Any suitable fusible interlining adhesive and method of application may be used. The adhesive may be applied uniformly or it, too, may have a multizonal distribution. Thus, the area of the web may also comprise zones which each have a substantially uniform adhesive coating and in which adjacent zones have different adhesive coatings.

The width of the zones of uniform binder content, and of any zones of uniform fiber content or uniform adhesive coating, can be varied widely but will generally be greater than 5 cm, for example 10 cm, or more. An interlining of the invention may contain just two zones of uniform binder content but often contains three separate zones of uniform binder content, and two intermediate zones. A continuous length of it conveniently contains five zones of uniform binder content across its width with the central zone being the stiffest, but any convenient number of zones can be provided.

The web may be subjected to conventional treatments, such as calendering or slitting.

BRIEF DESCRIPTION OF DRAWINGS

In order to illustrate the nature of the invention more fully, reference is made to the accompanying drawings in which:

In FIG. 6 there is shown a fabric having a repeat A B A wherein zones A and B are joined through an intermediate zone on either side of zone B. Zone B has a dimension approximately twice that of the width of zone A inasmuch as by disposing the patterns in head-to-head relationship, maximum use of non-woven fiber can be achieved.

DESCRIPTION OF SPECIFIC EMBODIMENTS

Figure 1:
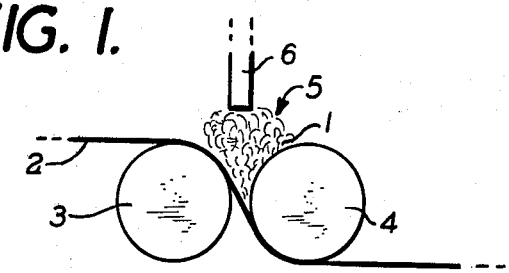
FIG. 1 is a diagrammatic side view.

Referring to the drawings, in FIG. 1 there is shown a foamed bonding agent 1 which is impregnated into a non-woven web 2 by passing the web over a support roll 3 and under a doctoring roll 4 so positioned as to define a pool 5 of adhesive across the width of the web. Generally the pool is maintained replenished by supply through one or more ducts 6.

Figure 2:
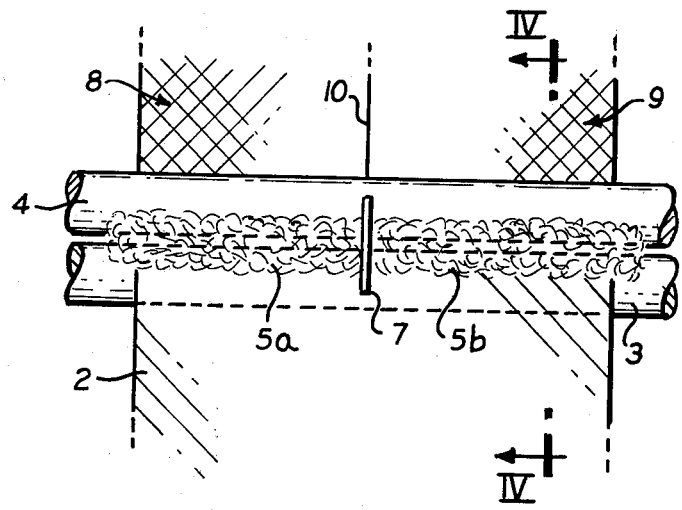
FIG. 2 is a plan view of a suitable apparatus useful in carrying out the process of the invention.

As shown in FIG. 2, in the invention the pool is divided into two pools, 5*a* and 5*b*, by a dividing plate 7. The apparatus includes separate supply ducts 6 for supplying the two different bonding agents to the two pools. One can design and position the dividing plate 7 so that the resulting impregnated web has longitudinal zones 8 and 9 which join one another along a line 10 at which there is a sharp change from one bonding agent to the other without any excessive overlapping of the two bonding agents and at which there is substantially no fiber displacement by the dividing plate 7.

Figure 3:
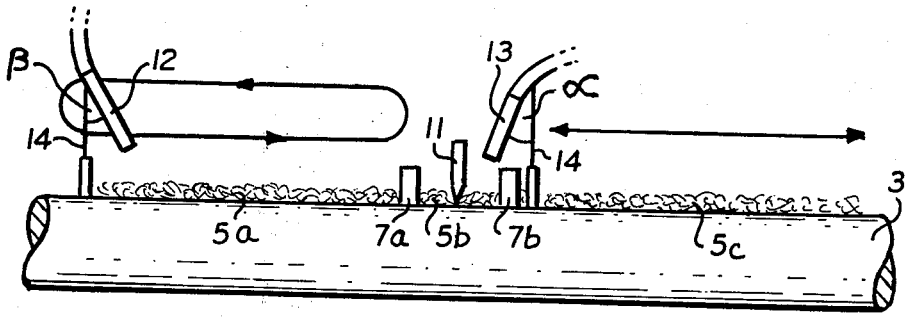
FIG. 3 is a side view of another suitable apparatus for carrying out the process of the invention.

The apparatus shown in FIG. 2 produces a bizonal effect but trizonal or higher multizonal effects can be achieved by providing additional dividing plates 7, a trizonal effect being achieved when there are two dividing plates, as shown in FIG. 3.

In this pool of bonding agent is divided into three sections 5*a*, 5*b* and 5*c*, the bulk of each pool being behind the roller 3 and therefore not visible in the drawings. These sections are separated from one another by baffles 7*a* and 7*b*. A rotor mixer 11 is provided in the intermediate pool 5*b* to mix the bonding agent therein.

The bonding agent for pool 5*a* is supplied through a traversing feed pipe 12 while the bonding agent for the pool 5*c* is supplied through a traversing feed pipe 13, each pipe being mounted on suitable traversing mechanism identified diagrammatically as 14. The pipes 12 and 13 discharge at an angle to the vertical so that even though the traverse mechanisms 14 move solely within the sections 5*a* and 5*b*, the outlets from the pipes do traverse the section 5*b*. By appropriate choice of the angles beta and alpha the proportions of the two bonding agents being fed into section 5*b* can be controlled.

Figure 4:
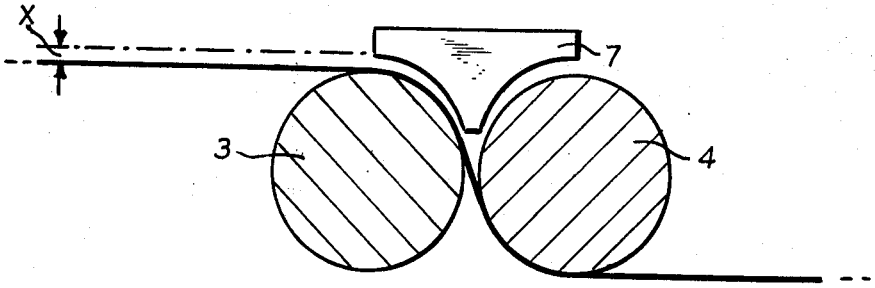
FIG. 4 is a cross sectional view taken along the line IV—IV of FIG. 2.

A suitable shaped dividing plate is shown in FIG. 4. The clearance x between the web 2 and the adjacent surface 12 of the dividing plate is usually small, for example from 2 mm to 12 mm, and is preferably adjustable both so as to accommodate different web thicknesses and also to permit the selection of the optimum separation for any particular bonding agent and web combination.

Figure 5:
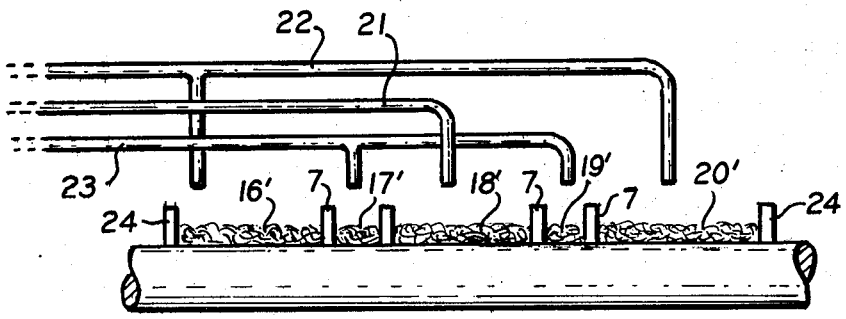
FIG. 5 is an elevation of another apparatus useful for carrying out the process of the invention.
Figure 6:
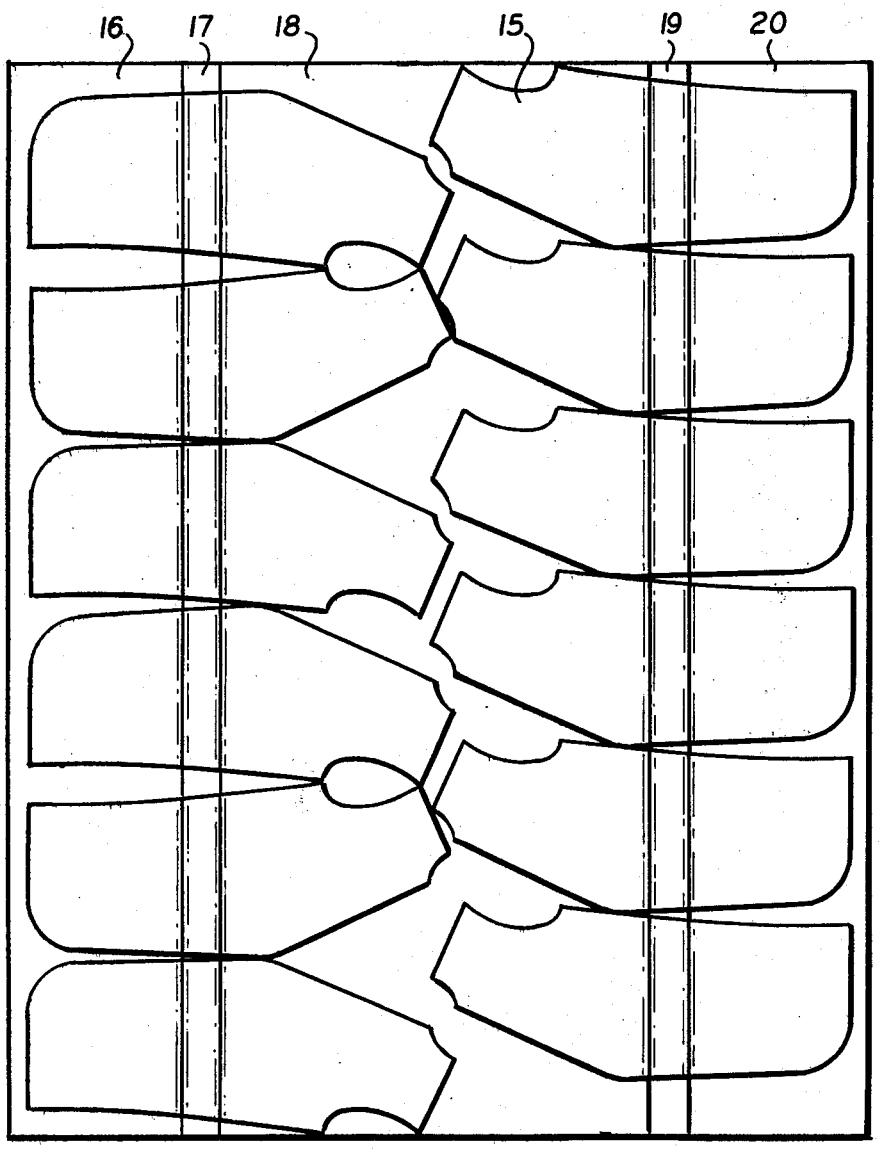
FIG. 6 is a plan view showing how patterns may be cut on a fabric according to the invention.

In FIG. 5 there is shown diagrammatically a preferred apparatus for forming five different zones of binder application. Four baffles 7 are provided to separate the zones and end plates 24 are provided. One binder composition is provided through duct 21 to the central zone 18', this composition being such as to give a fairly coarse fabric in that zone. A different composition that gives a much less coarse feel is provided through duct 22 to the outer zones 16' and 20' while a composition of intermediate properties is supplied through duct 23 to the intermediate pools 17' and 19'. In FIG. 6 is shown diagrammatically how interlining patterns may be laid on a length of the resultant multizonal fabric 15 to mark how the interlining is to be cut. The fabric is made up of zones 15, 16, 17, 18, 19 and 20. The properties such as bulk and stiffness of zone 17 are between those of zones 16 and 18, and those of zone 19 are between those of zones 15 and 20. In practice patterns would normally be laid so that the transitional zone (17 or 19) falls immediately below the top button position of the jacket forepart interlining.

Instead of supplying separate feeds to pools 17', 19', one can rely upon passage of binder over or under the baffles 7 from the adjacent pools 16', 18' and 20'. As an example of the web formed by this manner a five zone web is made by forming a web 160 cm wide using a card and cross lapper of a fiber mixture of:

| | |
|---|---|
| Nylon fiber 3.3d/tex 51 mm | 60% |
| Acrylic staple 8.9d/tex 60 mm | 20% |
| Polyester fiber 5.5d/tex 50mm | 20% |

and then depositing on the center of the loose web a web about 85 cm wide of nylon 22d/tex 83 mm. The web which consists of several layers of fibers is then passed through a Proctor Isomizer to produce a web in which zones 16 and 20 are 33 cm wide and have a fiber weight of 50 g/m$^2$ while zone 18 is 80 cm wide and has a fiber weight of 90 g/m$^2$, zones 17 and 19 thus each being about 7 cm wide.

Zone 15 is then impregnated with one binder composition, while zones 16 and 20 are impregnated with another, as described above. Each binder composition is pigmented and consists of

| | Liquid | Solid |
|---|---|---|
| Zones 16 and 20 | | |
| "Acronal" 35D (BASF (UK) Ltd) | 19.400 | 9.700 |
| Ammonium Oxalate | 0.176 | 0.176 |
| Sultrapon LQ (Cole & Wilson Ltd) | 0.295 | 0.118 |
| Water | 80.129 | — |
| | 100.000 | 9.994 |
| Zone 15 | | |
| "National" EP 2409 (National Adhesives and Resins Ltd.) | 46.450 | 21.150 |
| Ammonium Oxalate | 0.420 | 0.420 |
| "Sultapon" LQ | 0.639 | 0.256 |
| Water | 52.491 | — |
| | 100.000 | 21.826 |

The application conditions are

| | Zones 16 and 20 | Zone 15 |
|---|---|---|
| Foam Density | 96 gm/liter | 115 gm/liter |
| Gap between impregnation rollers | 0.6 mm | 0.6 mm |
| Baffle clearance | 5 mm | 8 mm |
| Binder solids | 10% | 22% |
| Zone widths | 33 cm each 7 cm | 80 cm |

The final product has a fiber:binder ratio of 70:30 in zone 15 and a ratio of 80:20 in zones 16 and 20 and a dry weight of 130 g/m$^2$ in zone 15 and of 62 g/m$^2$ in zones 16 and 20. Zone 15 is thus much firmer than the softer outer zones, not only because of the additional weight of binder but because the binder in zone 15 is formulated to give a distinctly stiffer effect.

What is claimed is:

1. An interlining material comprising a web of non-woven fibers, said web having a first zone having distributed uniformly therein binder, said first zone disposed proximate to but in out of contacting relationship with a second zone, said second zone having distributed uniformly therein binder, the binding characteristics of said first zone being distinctly different from the binding characteristics of said second zone, said zones being interconnected by an intermediate zone, said intermediate zone containing a mixture of the binder of said first zone and the binder of said second zone, said intermediate zone having binding characteristics that vary between the binding characteristics of said first and second zones, the binders of said first and second zones merging with one another in said intermediate zone said intermediate zone separating said first zone and said second zone having a width of at least 5 mm, said first zone and said second zone having a width of at least 5 cm, said zones being of a continuous length and running longitudinally.

2. An interlining material according to claim 1 wherein the fibers are longitudinally oriented.

3. An interlining material according to claim 1 wherein the dimension of said intermediate zone separating said first and second zone is between 1 and 5 cm.

4. An interlining material according to claim 1 in which the binders in adjacent zones are of different formulations.

5. An interlining material according to claim 1 in which the binders in adjacent zones are differently colored.

6. An interlining material according to claim 1 wherein the web comprises zones which each have substantially uniform fiber composition and in which adjacent said zones have different fiber compositions.

7. An interlining material according to claim 1 carrying a discontinuous adhesive coating thereon.

8. An interlining material according to claim 7 wherein the web comprises zones which each have a substantially uniform adhesive coating thereon and adjacent said zones have different adhesive coatings thereon.

9. An interlining material according to claim 8 wherein the web comprises zones which each have substantially uniform fiber composition and in which adjacent said zones have different fiber compositions.

* * * * *